US005515995A

United States Patent [19]

Allen et al.

[11] Patent Number: 5,515,995

[45] Date of Patent: May 14, 1996

[54] DOUBLE WALL BEVERAGE CONTAINER HAVING A WIDE BASE

[75] Inventors: Michael P. Allen, Nashville; Gary C. DeGrow, Goodlettsville; W. Burk Wyatt, Brentwood, all of Tenn.

[73] Assignee: Aladdin Synergetics, Inc., Nashville, Tenn.

[21] Appl. No.: 356,636

[22] Filed: Dec. 15, 1994

[51] Int. Cl.[6] ..... B65D 25/18

[52] U.S. Cl. ..... 220/410; 220/421; 220/719; 215/13.1

[58] Field of Search ..... 220/421, 427, 220/428, 410, 411, 412, 711, 703, 713, 714, 715, 719; 215/12.1, 13.1

[56] References Cited

U.S. PATENT DOCUMENTS

| | | | |
|---|---|---|---|
| 583,676 | 6/1897 | Emery | 220/412 |
| 2,338,455 | 1/1944 | Petri | 220/412 |
| 2,863,585 | 12/1958 | Meshberg . | |
| 2,895,636 | 7/1959 | Martin . | |
| 2,954,893 | 10/1960 | Sayre | 220/411 |
| 3,034,845 | 5/1962 | Haumann | 220/421 |
| 3,189,229 | 6/1965 | Carroll et al. | 215/12.1 |
| 3,191,794 | 6/1965 | Perkins | 220/421 |
| 3,355,046 | 11/1967 | Jolly | 215/13.1 |
| 3,684,123 | 8/1972 | Bridges . | |
| 3,861,565 | 1/1975 | Rickmeier, Jr. . | |
| 4,151,923 | 5/1979 | Bernardi . | |
| 4,243,156 | 1/1981 | Lobbestael . | |
| 4,333,583 | 6/1982 | Montemarano . | |
| 4,394,928 | 7/1983 | Philip . | |
| 4,428,498 | 1/1984 | Obey . | |
| 4,481,779 | 11/1984 | Barthel | 220/421 |
| 4,586,625 | 5/1986 | Garrett . | |
| 4,595,437 | 6/1986 | Yamamoto . | |
| 4,618,066 | 10/1986 | Vail . | |
| 4,756,443 | 7/1988 | Murayama . | |
| 4,767,019 | 8/1988 | Horner . | |
| 4,953,737 | 9/1990 | Meyers . | |
| 4,961,510 | 10/1990 | Dvoracek . | |
| 5,040,317 | 8/1991 | Kadjevich | 220/410 |
| 5,143,248 | 9/1992 | Sawatsky . | |
| 5,217,141 | 6/1993 | Ross . | |
| 5,294,014 | 3/1994 | Wyatt et al. . | |
| 5,454,482 | 10/1995 | Simon | 220/713 |
| 5,456,380 | 10/1995 | Ito et al. | 220/713 |

FOREIGN PATENT DOCUMENTS

| | | | |
|---|---|---|---|
| 2139349 | 5/1990 | Japan . | |
| 222544 | 10/1924 | United Kingdom | 220/421 |
| 582294 | 11/1946 | United Kingdom . | |
| 742780 | 1/1956 | United Kingdom | 220/421 |

OTHER PUBLICATIONS

Xerographic Copy of a beverage mug (base).

*Primary Examiner*—Stephen J. Castellano
*Attorney, Agent, or Firm*—Greenblum & Bernstein

[57] ABSTRACT

The present invention provides a beverage mug for containing hot or cold beverages without substantial spillage. The beverage mug comprises an endless outer wall having an open top and bottom, and an endless inner wall having an open top and bottom, each of which comprises a base portion, a mouth portion, and optionally, a neck portion. The base portion of each of the inner and outer walls is substantially wider in the direction generally perpendicular to the vertical axis, i.e., when viewed from the top, than said mouth portion from the same perspective, so as to impart stability to the mug and resist tipping of the mug. Advantageously, the first and second walls define an insulating space sufficient to retard heat transfer to or from a beverage contained in the mug. In preferred embodiments, the mug is formed in four sections, joined in three joints to form the mug, comprising the outer wall, the inner wall, a base portion joined to the inner wall and a base portion joined to the outer wall. A method aspect of the invention is also provided.

16 Claims, 6 Drawing Sheets

DOUBLE WALL BEVERAGE CONTAINER HAVING A WIDE BASE

BACKGROUND OF THE INVENTION

1. Field of the Invention

This invention relates to a double wall beverage container or mug having a wide base, and, in particular, to a double wall beverage mug for containing hot or cold beverages without substantial spillage and wherein the base portion of the beverage mug is substantially wider than the mouth portion of the beverage mug.

2. Background of the Invention and Related Art

Double wall beverage containers for maintaining cold liquids cold and hot liquids hot have long been known in the art. Examples of such beverage containers include U.S. Pat. No. 2,895,636 to MARTIN; U.S. Pat. No. 3,861,565 to RICKMEIER; U.S. Pat. No. 4,151,923 to BERNARDI; U.S. Pat. No. 4,595,437 to YAMIMOTO; U.S. Pat. No. 4,618,066 to VAIL; and British Patent No. 582,294 to WHEELER. U.S. Pat. No. 3,684,123 to BRIDGES, which is hereby incorporated by reference, as though set forth in full herein, discloses a double wall beverage mug. None of these documents, however, discloses a double wall beverage mug for containing hot or cold beverages without substantial spillage and having a base portion substantially wider than the mouth portion of the mug.

British Patent No. 582,294 to WHEELER discloses a container, for the transport and storage of liquids, such as milk in bulk, wherein the container has spaced inner and outer walls to retard heat transfer of the materials stored therein. The container requires the use of a plurality of struts, webs or ribs arranged in the form of a spider so as to provide means whereby the inner and outer walls are mutually supported. Additionally, the outer wall of the container base is formed in a relatively complicated process wherein a lower cylindrical portion of the outer wall is deformed at elevated temperature by a crimping operation so as to produce a series of tapering corrugations, and is progressively turned over inwardly so that the corrugated part becomes a closure for the bottom end of the outer portion, the corrugations assuming a radial disposition and leaving a small central hole which must be plugged with a cementing composition.

ROSS, U.S. Pat. No. 5,217,141, discloses a drinking mug and lid. In one embodiment, the drinking mug has a base which is substantially wider than a neck portion of the mug. In this embodiment, the mug is of a solid wall construction employing only a single wall. In other embodiments, the mug is of a double wall construction; however, in these embodiments, the inner and outer walls are generally right cylindrical.

Mugs wherein the base portion is substantially wider than the mouth portion thereof have generally been constructed of a single wall design. Where a double wall construction is employed for a mug having a wide base portion, the inner wall is generally substantially cylindrical. This has been so because conventional wisdom dictates that the most efficient way to manufacture such a mug is by means wherein the inner liner is generally cylindrical. This is particularly important when processes such as injection molding are employed because liners having a wide base would be difficult, if not impossible, to remove from a mold part in which they were formed. Thus, wide base mugs which result from attempts to provide a wide base mug with double wall construction suffer from a lack of capacity to contain a substantial volume of beverage, at least in part because the inner wall of the mug does not follow the contour of the outer wall of the mug. The volume capacity that would result from usefully employing the entire volume defined by the overall shape of the outer wall of the mug is not realized. Thus, conventional wisdom has dictated that mugs having a double wall construction and a wide base must either have a volume capacity limited to the generally cylindrical shape of the liner or inner wall, and such mugs having a wide base do not utilize the "dead" space between the inner and outer walls of the mug at the base thereof.

The foregoing approaches have failed to provide a double wall insulated beverage container having a substantially wide bottom portion which is capable of containing beverages and retarding transfer of heat to or from such beverages while providing a relatively high-volume beverage capacity also while having a low center of gravity, increased stability and a resistance to tipping of the mug, while substantially inhibiting spillage of the beverage, and there has been a continuing need for improvement.

SUMMARY OF THE INVENTION

Accordingly, it is an object of the present invention to provide a beverage mug for containing hot or cold beverages and retarding heat transfer to or from the beverage contained therein, wherein the beverage mug also exhibits increased stability, has a low center of gravity and resists spillage of the beverage and tipping of the mug.

It is a further object of the invention to provide such a beverage mug having the foregoing advantages without sacrificing volumetric capacity, and having increased capacity with respect to generally cylindrical mugs or mugs having a generally cylindrical interior wall.

The present invention provides a beverage mug for containing hot or cold beverages without substantial spillage. The beverage mug comprises an endless outer wall having an open top and open bottom and an endless inner wall having an open top and bottom. The outer wall comprises a base portion, a mouth portion, and optionally, a neck portion. The inner wall also comprises a base portion, a mouth portion, and optionally, a neck portion. The base portion of each of the inner and outer walls has a horizontal cross-sectional area substantially greater than the horizontal cross-sectional area of the mouth portion, from the same perspective, i.e., when viewed from the top, so as to impart stability to the mug and resist tipping of the mug. The inner wall has a base wall member secured thereto and the outer wall also has a base wall member secured thereto. The inner and outer walls are secured to each other at the mouth portion of each wall. Advantageously, the first and second walls and the base wall members define an insulating space sufficient to retard heat transfer to or from a beverage contained in the mug.

In preferred embodiments, the mug is formed in four sections comprising the outer wall, the inner wall, a base portion joined to the inner wall and a base portion joined to the outer wall. In such embodiments, the inner and outer walls are joined to each other at or near the mouth portion of the mug and the base portion of the inner wall is joined to the end of the inner wall which is distal from the mouth portion of the inner wall. The base portion of the outer wall is joined to the end of the outer wall which is distal from the mouth portion, as well.

In a method aspect of the invention, a method of producing a double wall beverage mug having a wide base, and capable of containing hot or cold beverages without substantial spillage, is provided. In the method, an inner base wall member is joined to the bottom end of an endless inner wall. The endless inner wall has an open top and open bottom, and a base portion and a mouth portion, wherein the base portion has a horizontal cross-sectional area substantially greater than the horizontal cross-sectional area of said mouth portion.

The inner wall of the mug is then joined to an endless outer wall. The endless outer wall also has an open bottom, and open top and a base portion and a mouth portion, wherein said base portion has a cross-sectional area substantially greater than the cross-sectional area of said mouth portion, the joining being conducted at said mouth portion of each wall.

Thereafter, a outer base wall member is joined to said bottom end of said outer wall so as to provide a contiguous outer wall for the mug.

The method results in a double wall, wide body mug having a wide base and wherein the inner walls substantially follow the contours of the outer walls. A wide base mug having increased stability, but also having the ability to keep hot beverages hot and cold beverages cold by reducing heat transfer to or from such beverages, and also having increased capacity results.

BRIEF DESCRIPTION OF THE DRAWINGS

The foregoing and other objects, features, and advantages of the invention will be apparent from the following more particular description of the preferred embodiment, as illustrated in the accompanying drawings in which reference characters refer to the same parts throughout the various views, and wherein.

DETAILED DESCRIPTION OF PREFERRED EMBODIMENTS OF THE INVENTION

Figure 1:
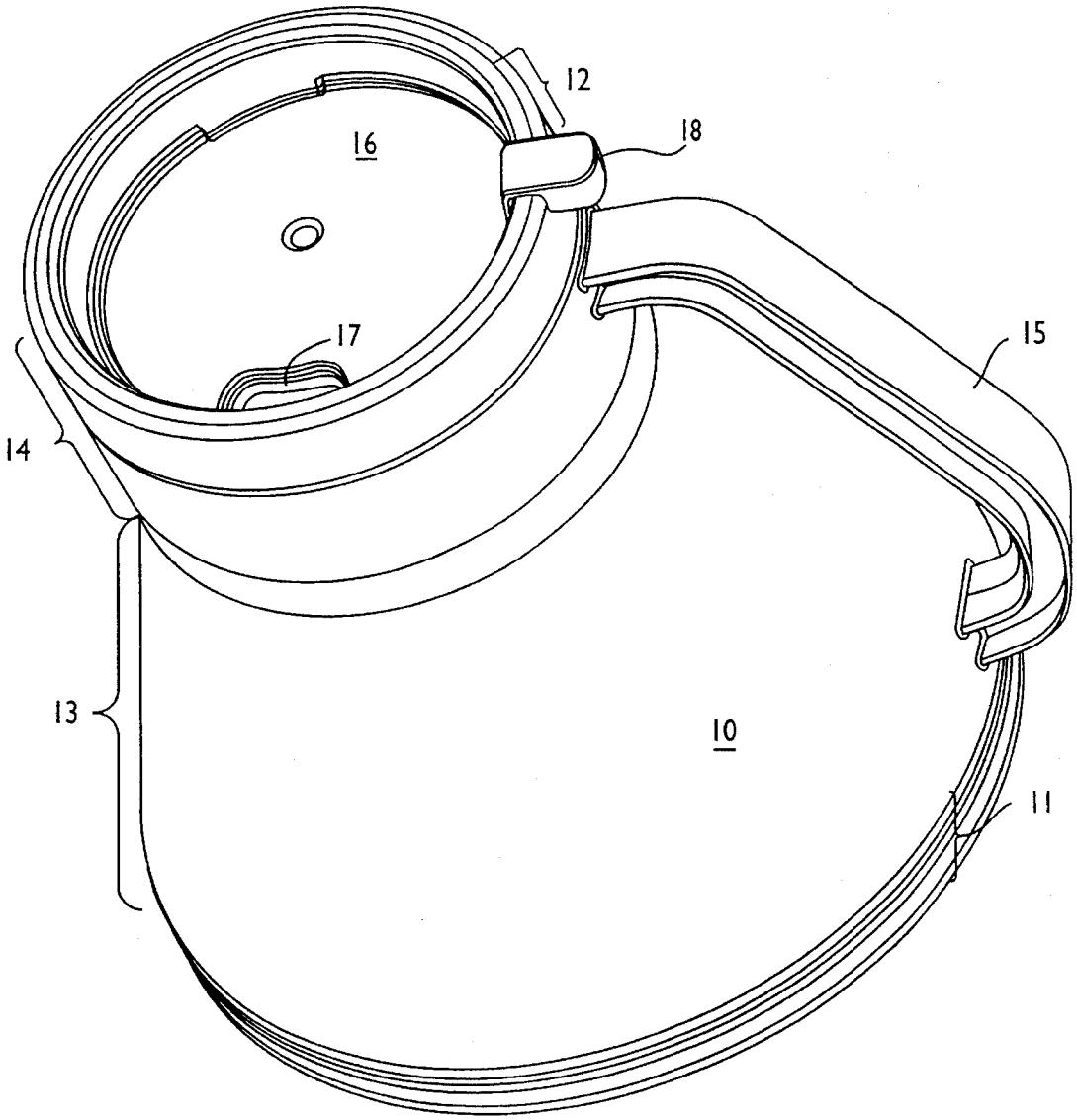
FIG. 1 is a perspective view of the outside portion of a beverage mug of the invention.

FIG. 1 discloses a wide body mug of the invention, designated generally as 10. The mug has a base portion generally designated as 11, having a diameter which is substantially larger than the diameter of the mouth portion, generally designated as 12. The walls of the mug have a generally tapered portion 13, and, in preferred embodiments, a generally cylindrical portion 14. Preferably, the mug is provided with a handle 15 of suitable shape. The mug can also be provided with a lid, designated generally as 16. Preferred lids are described in more detail below.

Figure 3:
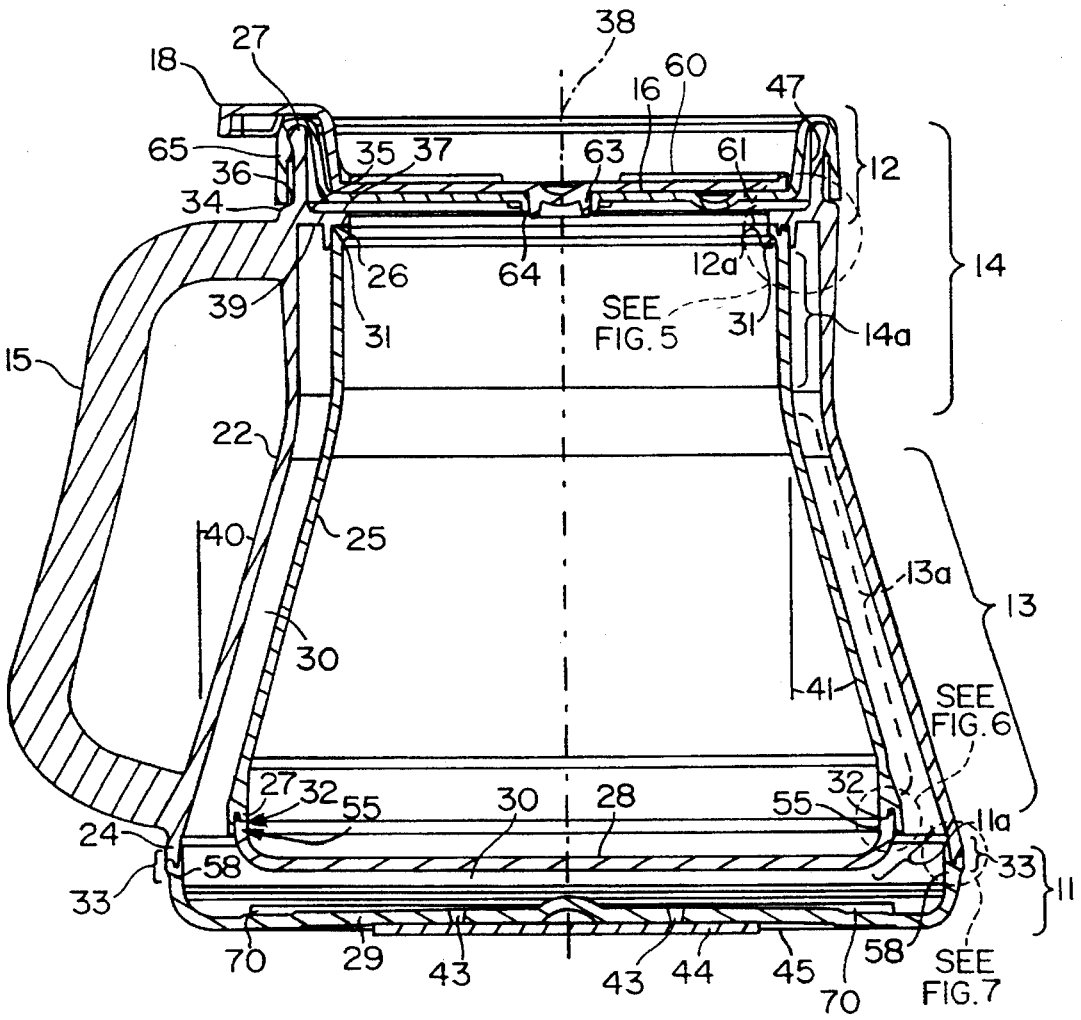
FIG. 3 is a cross-section taken generally along the plane designated by line 3—3 of FIG. 2.

FIG. 3, shows the relationship of the inner wall 22 of the mug to the outer wall 25 of the mug. In this embodiment, the outer wall of the mug has a generally cylindrical neck portion 14, a generally tapered portion 13, and a lower end 24. The inner wall also has a generally cylindrical neck portion 14*a*, a generally tapered portion 13*a* and a lower end 27. The contour of the inner wall generally follows the contour of the outer wall. In this embodiment, the contour of the inner wall substantially follows the contour of the outer wall throughout most of the area of the walls, preferably almost all of the area of the walls. In other embodiments, the inner wall follows the contour of the outer wall throughout a substantial length of the wall at a horizontal cross-section of the mug, e.g., the cross-section of FIG. 3, preferably substantially all of the length of the outer wall at such cross-section. Thus, the space 30 defined by the inner and outer walls has a substantially constant thickness.

In preferred embodiments, the inner wall is substantially equidistant from the outer wall throughout a substantial length of the walls at a horizontal cross-section of the mug, e.g., the cross-section of FIG. 3. Preferably, the inner wall is substantially equidistant from the outer wall throughout a substantial area of the walls. As used herein, the term substantially equidistant refers to the distance between the two walls over the length or area in question varying less than about ½ inch, preferably less than about ¼ inch, and most preferably less than about ⅛ inch.

Each wall has a mouth portion and a base portion. Thus, the outer wall 22 is provided with mouth portion 12 as part of the neck portion, and the inner wall 25 is provided with mouth portion 12*a*. The outer wall is provided with a base portion 11, of which lower end 24 is a part and the inner wall is provided with a base portion, of which lower end 27 is a part.

The outer wall 22 has a first end 23 defining a mouth of the outer wall which, when the lid is removed, also constitutes the upper end of the mug. The mouth defined by upper end 23 of wall 22 is part of the mouth portion 12 of the mug. The outer wall also has a lower end 24. Lower end 24 is distal from the mouth portion of the mug and is especially adapted to engage and be secured to the base portion 29 of the mug, as will be described below. Inner wall 25 also has a first end 26 which is proximal to the mouth portion 12 of the mug, and forms mouth 12*a* of the inner wall of the mug. The inner wall also has a second end 27 which is distal to the first end and which has a diameter substantially larger than the diameter of the first end.

The second end 27 is also especially adapted to engage and be secured to the upper end or portion 55 of the inner wall base portion 28. When secured to the inner wall, by suitable means, in preferred embodiments, the inner wall and the inner base member form a contiguous inner liner which essentially follows the contour of the outer wall.

When the outer base wall member 29 is secured to lower end 24 of the outer wall, an essentially contiguous outer wall defining the outer shape of the beverage mug results. The contiguous outer wall formed by outer wall 22 and outer wall base member 29, and inner wall 25 and inner wall base member 28, define an insulating space 30 which is at least substantially continuous and preferably continuous between the walls throughout the length of the space defined by the inner and outer walls and the inner and outer base members.

When so constructed, each of the inner wall base member 28 and outer wall base member 29 is disposed perpendicular to the vertical axis 38 of the mug. Preferably, inner wall 25 and outer wall 22, inner wall base member 28 and inner wall base member 29 are coaxially disposed along axis 38.

Figure 2:
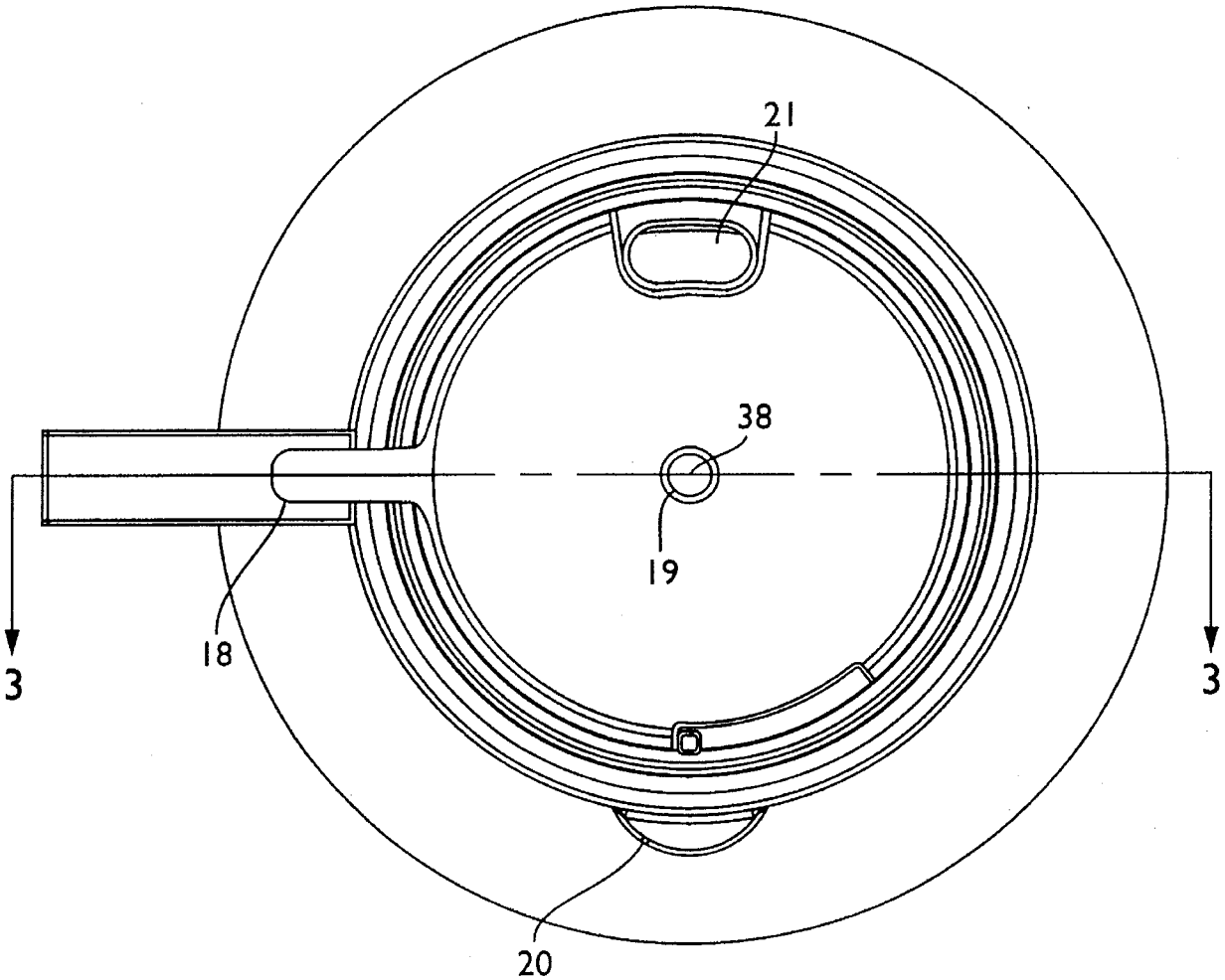
FIG. 2 is a top plan view taken generally on the vertical axis of the beverage mug of FIG. 1.

FIG. 2 shows an embodiment of the invention wherein the inner and outer walls of the mug are generally circular in top plan view. Referring to FIGS. 2 and 3, it is shown that the inner and outer walls are coaxial with vertical axis 38.

Thus, in this preferred embodiment, the beverage mug of the invention comprises four parts, the outer wall portion 22, the inner wall portion 25, the inner wall base member 28, and the outer wall base member 29. In this embodiment, these parts are joined together in three locations. Thus, the beverage mug of this embodiment comprises three joints. The inner wall and outer wall are joined to each other at joint 31, the inner base member 28 is joined to the second end of the inner wall member 25 at joint 32, and the outer base wall member is joined to the second end 24 of the outer base wall 22 at joint 33.

These joints may be accomplished by conventional means well known to those of ordinary skill in the art and those of ordinary skill can readily select an optimal method of joining these parts. Suitable methods include, but are not limited to, e.g., solvent welding, ultrasonic welding and spin welding. For the embodiment of the invention depicted in FIGS. 1–7, spin welding is especially preferred. Although discussed in more detail below, spin welding techniques are well known to those of ordinary skill in the art and those of ordinary skill can readily apply such techniques to fabricate the beverage mug of the invention. In order to facilitate the spin welding operation, the ends of the walls of each part are specially shaped as will be described more fully hereinafter.

Advantageously, the mouth portion of the outer wall member 22 is provided with an exterior shoulder 34 and an interior shoulder 35. These shoulders, especially shoulder 35, provide axial support to the parts to be joined at joint 31 during spin welding. Each shoulder provides a surface 36 and 37 which is generally perpendicular to the vertical axis 38 of the beverage mug. Preferably, the inner wall 25 is joined to the outer wall 22 at joint 31 on the portion of shoulder 35 which faces the bottom of the mug, generally designated as 39, and discussed in more detail below.

Figure 8:
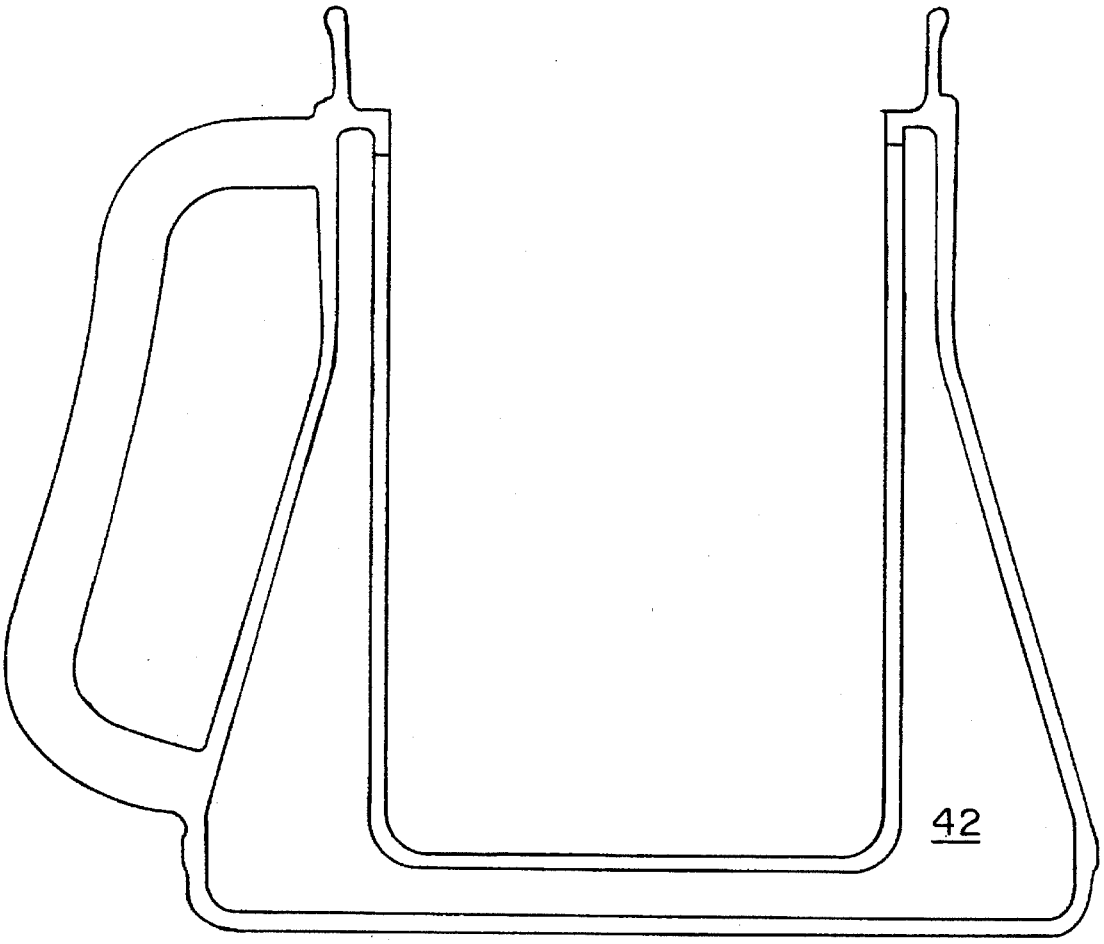
FIG. 8 PRIOR ART
FIG. 8 is a schematic representation of a cross-section of a double wall, wide base mug of the prior art.

A significant advance offered by the present invention is the fact that mug stability is increased, while beverage heat transfer is reduced, spillage is reduced, and volume or capacity is increased. In prior art mugs, a gain in the desirable aspects of one of these attributes is usually attained at the expense of another of these attributes. For example, in order to obtain increased capacity in prior art double-wall, wide base beverage mugs, it has been necessary to increase the overall height of the container, because prior art beverage mugs necessarily result in a large amount of lost, unusable, "dead" space. This is illustrated in FIG. 8 by the space generally designated 42. In general, the beverage mugs of the present invention need not be as tall as other double wall beverage mugs in order to achieve similar, or even greater, capacity, because the wide base portion, and in particular, the wide base portion of the inner wall or liner, allows for very significant volumes of beverage to be retained in the base portion of the mug of the invention. This is accomplished without the need to provide axial ribs or similar support members between the inner and outer wall. Thus, such axial ribs, which in prior art double wall containers can be integral with either the inner or outer wall, are not required in the present invention.

Other than the requirement that the base portion of each of the inner and outer walls be wider than the mouth portion of the inner and outer walls, there is no requirement that the side walls of the beverage mug of the present invention assume a predetermined shape. Thus, the side walls can be generally tapered, as shown in the drawings, and include a generally tapered, frustoconical portion and a generally cylindrical portion, or they can be tapered, or frustoconical without a cylindrical portion. Moreover, the walls can be generally curvilinear. In addition, a portion of the mug, such as the base portion or mouth portion, or the entire mug can have a polygonal, oval or other non-circular shape in top plan view. However, whatever shape is employed, the diameter (or the corresponding horizontal dimension in the case of a non-circular top plan shape) of the base portion of the inner wall is substantially larger than the diameter of the first end of the inner wall, and the diameter of the base portion of the outer wall is substantially larger than the diameter of the first end of the outer wall.

For circular embodiments, the ratio of the diameter of the base portion of the outer wall to the diameter of the first or mouth portion of the outer wall can be from 6/2.5 to about 5/4.5, preferably about 5/3.6. The ratio of the diameter of the base portion of the inner wall to the mouth portion or first end of the inner wall is from about 5/1.5 to about 4/3.5, preferably about 4/2.6. The corresponding areas of the circles of the cross-sections can be readily calculated. This calculation can also be readily applied to non-circular embodiments to provide suitable ratios of the invention.

In preferred embodiments, the taper of each of the inner and outer walls of the beverage mug of this invention has an angle of at least 10° with respect to a plane parallel with vertical axis 38, preferably at least about 16°. In the beverage mug illustrated by FIG. 3, the angle 41 with respect to vertical axis 38 of the inner wall 25 at tapered portion **13*a* is about 16° and the angle 40 with respect to vertical axis 38 at the outer wall 22 at tapered portion 13** is about 17°.

The foregoing results in a mug of significantly higher capacity than conventional or prior art double wall, wide base mugs of the same or similar height. For example, the beverage mugs of the present invention can hold from 12–32 ounces. The beverage mug depicted in FIGS. 1–7, when produced in a scale wherein the base portion of the inner wall has an inner diameter of about 4 inches and the mouth portion of the inner wall has a diameter of about 2¾ inches and the inner liner has an overall height, measured at the mouth portion of the inner liner, of about 3 15/16 inches, has a capacity of about 20 ounces.

Preferably, the bottom wall or base wall member of the outer wall is provided with venting holes 43 for venting the interior of the space defined by the inner and outer walls. This is useful to allow air to escape, such as when the insulating space 30 has been filled with foam insulating material which has not yet cured and is in the process of curing and/or expanding when the outer base wall member is secured to the outer wall member of the beverage mug. The outer bottom wall member 29 is also provided with suitable generally radially extending ribs 70. These ribs, which may be integral with the outer bottom wall member, impart stiffness and rigidity to the outer bottom wall portion. In any event, however, the ribs do not extend the entire distance between the inner and outer bottom wall members, and in fact need not be relatively deep. In general, the ribs will have a width which extends upward from the outer bottom wall member only a small fraction, e.g., ⅛ inch, of the distance between the inner and outer bottom wall members. The latter distance can be, e.g., ¼ inch.

The bottom of the beverage mug can be provided with a pad 44 of suitable material, such as Neoprene foam or the like, to provide a stable bottom that does not slip readily. This is preferably provided in a recessed portion 45 of the base wall. A flat bottom can be alternatively provided.

Figure 4:
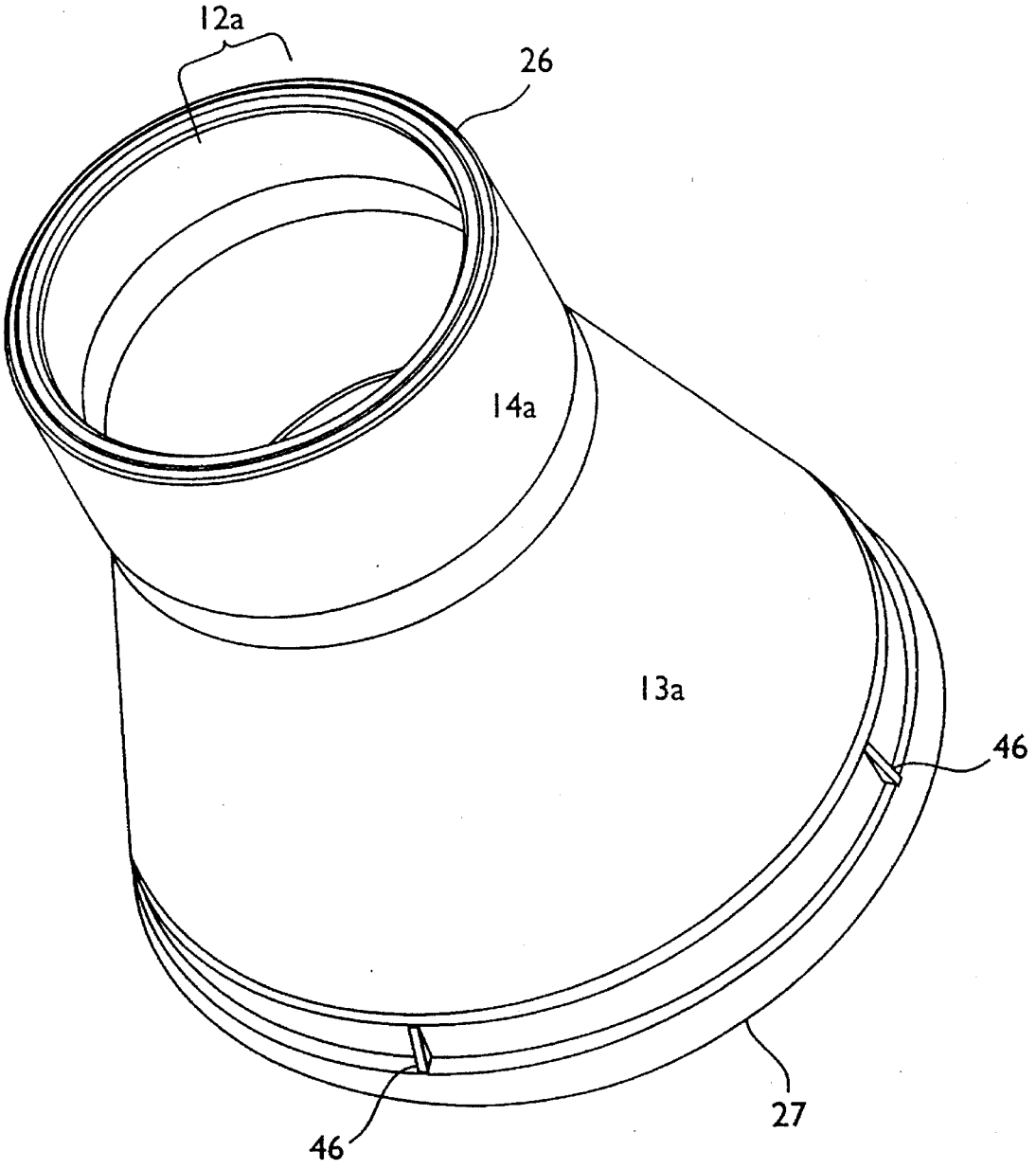
FIG. 4 is a perspective view of the inner wall or liner of FIGS. 1—3.

A preferred embodiment of the inner wall or liner is shown in perspective in FIG. 4. The inner wall has a first end 26, as discussed above, and is preferably configured as discussed more fully below. Preferably, axially disposed ribs 46 are provided to facilitate spin welding as discussed more fully below. The inner wall, as discussed above, has a generally cylindrical portion 14*a* and a generally tapered portion 13*a* and a mouth portion generally designated at 12*a*. Also as discussed above, the inner wall has a second or distal end 27.

Figure 5:
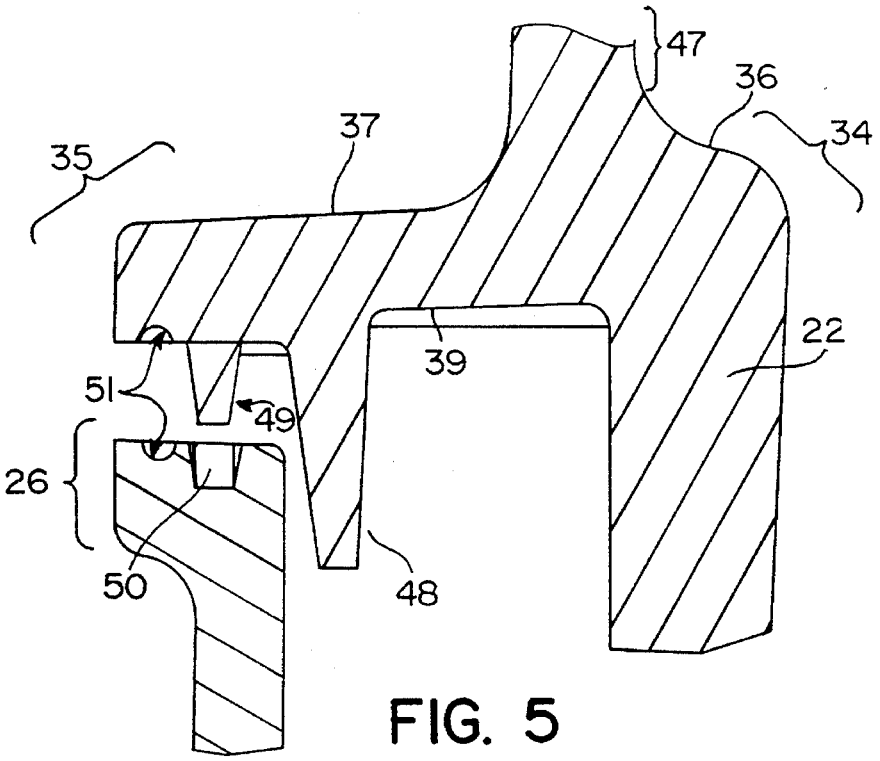
FIG. 5 is an enlarged, exploded, fragmentary cross-section of the joint between the inner wall and the outer wall of the mug, prior to assembly or joining, taken generally at portion 5 of FIG. 3.
Figure 6:
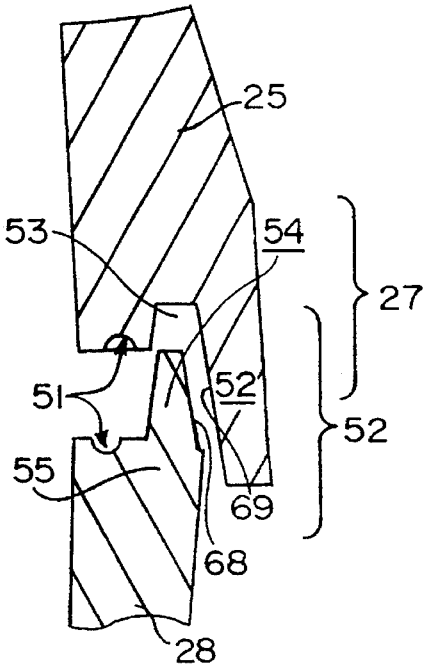
FIG. 6 is an enlarged, exploded, fragmentary cross-section of the joint between the inner wall and the inner wall base section, prior to assembly or joining, taken generally at portion 6 of FIG. 3.
Figure 7:
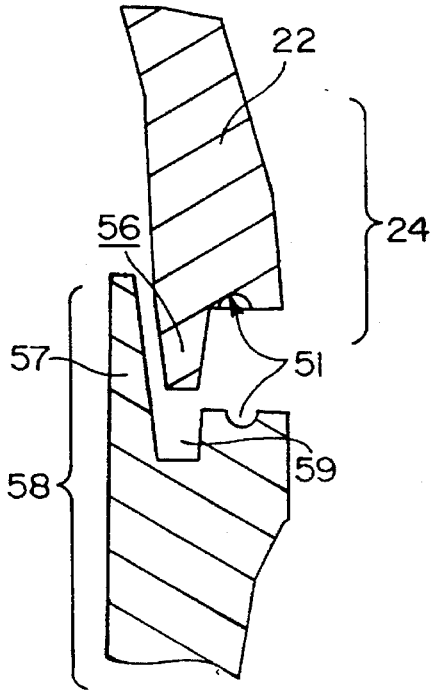
FIG. 7 is an enlarged, exploded, fragmentary cross-section of the joint between the outer wall and the base portion of the outer wall, prior to assembly or joining, taken generally at portion 7 of FIG. 3.

Suitable configurations of the ends of each of the inner and outer walls, as well as the ends of the base members, to facilitate spin welding, are disclosed in FIGS. 5–7. FIG. 5, an enlarged, exploded view of the portion taken at portion 5 of FIG. 3, prior to assembly or joining, discloses outer wall 22 having an exterior shoulder 34 and an interior shoulder 35. The exterior and interior shoulders are provided with transverse surfaces 36 and 37, as discussed above. Interior shoulder 35 is also provided with a transverse surface 39 which faces downwardly toward the bottom of the mug. The inner wall continues upwardly to form an annular sleeve structure 47, also shown in full in FIG. 3. This sleeve structure can function as a lip of the beverage mug on which can be disposed a lid or lid assembly as shown in FIG. 3.

In order to facilitate spin welding, the downwardly facing face 39 of shoulder 35 is provided with annular beads or leads. Thus, there is provided a relatively long lead 48, a shorter bead or lead 49 which is adapted to mate in annular groove 50, in the first end 26 of the inner wall 25. Each of the opposed faces of the shoulder 35 and end 26 are provided with an annular groove 51 which is semi-circular in cross-section. These grooves serve as reservoirs for molten material melted from the joints of the walls during spin welding. Similar semi-circular annular grooves are found in FIGS. 6—7. The cross-sectional shape of the end 26 of wall 25 and the leads of shoulder 35 facilitate spin welding, such that when inner wall 25 is rotated relative to the outer wall 22 (or when the outer wall is rotated and the inner wall is held stationary), substantial friction results in melting of the material of the wall and fusing of the wall into a unitary mass at joint 31.

FIGS. 6–7 illustrate similar cross-sectional shapes for facilitating spin welding at joints 33 and 32. Thus, referring to FIG. 6, lower or second end 27 of inner wall 25 is provided with a lead or bead 52 and a groove 53, adapted to engage and cooperate with the lead 54 of the upper portion 55 of the inner base member 28. As shown in FIG. 7, similar leads 56 and 57 are formed in the lower or second end portion 24 of outer wall 22 and the upper end portion 58 of the outer base member 29. Similarly, upper end portion 58 of base member 29 is provided with a groove 59. These shapes cooperate also to facilitate spin welding, as described above, and is described in more detail below. Also, as described above, the inner wall may be provided with ribs 46 to facilitate spin welding such that the ribs cooperate with a similarly shaped part of a tool to assist in rotating the inner wall about its vertical axis, or maintaining the inner wall stationary by ensuring that there is no relative motion between the inner wall and the tool.

Those of ordinary skill in the art can readily select other optimal shapes for the cross-sections of the walls to be spin welded.

The walls of the mug may be made of any suitable material, e.g., a polyolefin, e.g., polypropylene or polyethylene, in copolymeric or homopolymeric form. Additionally, engineering resins can be employed, such as, e.g., acrylonitrile/butadiene/styrene, polycarbonates, styrene acrylonitrile, etc. Those of ordinary skill in the art can readily select a suitable material, without undue experimentation, from well known commercial sources.

A preferred lid is shown in FIGS. 1–3. Preferably, the lid 16 is provided with a beverage dispensing and drinking aperture 17. In some preferred embodiments, a lid which is selectively openable and closable by means of a rotating disk 60 that rotates relative to a lid base or body 61 can be employed. In such a case, the disk of the lid is actuated by a suitable lever 18. Suitable such disks and suitable such lid constructions are disclosed in WYATT et al., U.S. Pat. No. 5,294,014, which is hereby incorporated by reference, as though set forth in full herein. Such lids generally include a body portion of the lid, having a dispensing orifice therein, and a rotating disk portion, also having an opening which can be brought into registry with the dispensing orifice of the body portion of the lid when the disk is rotated by means of actuation of the lever 18. Advantageously, the disk and body are connected by means of an axle 19, about which the disk rotates relative to the body. As is also shown in FIG. 3, the axle 19 can include a generally bead shaped member 63 integral with the disk and inserted through the opening 64 in the base member. The body of the lid assembly is advantageously provided with a tab 20 so that the lid assembly may be easily removed from the mouth portion of the beverage mug.

The lid preferably "snap fits" into the interior of the mouth portion, or "snap fits" over the exterior of the mouth portion, depending on the type of lid employed, suitable cooperating snap means being provided on a suitable portion of the mouth portion of the mug, such as is shown in WYATT et al., U.S. Pat. No. 5,294,014, referenced above. Thus, as is shown in FIG. 3, the base member may be provided with a generally U-shaped skirt 65, which is adapted to be snapped over the sleeve-shaped member 47.

In the configuration shown in FIGS. 1 and 2, the aperture or opening of the rotating disk is in registration with the aperture or opening of the body of the lid, so as to provide a dispensing opening 21. Suitable vent means may also be employed to allow the ingress of air to replace the volume of the beverage being dispensed from the beverage mug through opening 21. Thus, in preferred embodiments, the rotating disk is provided with a venting aperture which is positioned to be in registration with a corresponding venting aperture in the body of the lid, when the dispensing apertures in the disk and body of the lid are also in registration. As will be readily understood, other types of lids can be employed in connection with the beverage mug of this invention.

With reference first to FIG. 6, production assembly of the beverage mug may be accomplished at joint 32 by placing inner base wall portion 28 over the distal or second end 27 of inner wall 25 and engaging these parts such that lead or bead 54 is cooperatively engaged in groove 53 and such that opposed inclined surfaces 68 and 69 are cooperatively engaged. The inner wall 25 and base member 28 are then rotated relative to each other until a sufficient spin weld is obtained.

This spin welding operation is accomplished by rotating the parts relative to each other about vertical axis 38 of the mug with sufficient axial pressure and sufficient velocity to impart enough friction to the joint to melt the material at least of the leads or beads 52 and 54, and also immediately adjacent to groove 53 so as to fuse the material into a unitary mass resulting in an annular joint which is completely sealed.

Such spin welding operations are well known to those of ordinary skill in the art and how to carry out such an operation is well known to those of ordinary skill in the art. In general terms, spin welding is accomplished by supporting one of the parts to be welded on, e.g., a mandrel or other tool. In spin welding the joint shown in FIG. 6, the inner wall 25 is supported on a suitable tool having recesses therein capable of engaging and cooperating ribs 46 shown in FIG. 4, so as to eliminate relative rotational movement between the tool and the inner wall 25. Inner wall base member 28 is then placed over the distal end 27 of the inner wall in the manner shown in FIG. 6. Then the inner wall 25 and inner wall base member 28 are rotated relative to each other, either by rotating the inner wall and maintaining the base member stationary, or rotating the base member and maintaining the inner wall stationary. Alternatively, both parts could be rotated. A suitable degree of axial force is applied to the parts and a suitable velocity is employed to result in melting the material of the parts at the joint. The molten material fuses and becomes unitary. Those of ordinary skill can readily optimize the foregoing conditions to provide a suitable spin weld.

In the next step, a similar procedure is repeated at joint 31 by inserting the upper end 26 of the inner wall 25 at shoulder 35 of the outer wall 32, so that the end portion 26 of the inner wall faces the face portion 39 of the shoulder 35 in the manner shown in FIG. 5, and engaging the elements such that lead or bead 49 is fully inserted in groove 50 and the other portions of the joint are similarly cooperatively engaged. This joint is then spin welded as was joint 32, the production of which was described as the first step, above. The insulating space 30 is then filled with suitable insulating material, such as expanding foam material. Suitable foam materials include open cell foams and closed cell foams, preferably, closed cell foams, including foam polyurethane. Once the outer base wall member has been sealed to the lower end of the outer wall, the foam will continue to expand. Atmosphere will be allowed to escape through vent holes 43.

The procedure above is repeated for the outer base wall member as shown in FIG. 7 and as was previously discussed for the joint of FIG. 6. Thus, as the final step, the outer wall base member 29 is spun welded at joint 33 by inserting lead or bead 56 of to the lower or distal end 24 of the outer wall 22, into groove 59 of the outer base wall member 29 to form joint 33.

Pad 44 can be subsequently applied to the base.

The foregoing description is provided in an illustrative, rather than limitative, sense and it will be understood that various variations and changes in the materials and arrangement of the parts, which have been herein described and illustrated in order to explain the nature of the invention, may be made by those skilled in the art without departing from the spirit or scope of the invention.

What is claimed is:

1. A beverage mug for containing hot or cold beverages without substantial spillage, said beverage mug being formed of polymeric plastic and comprising:

an endless outer wall having an open top and open bottom;

an endless inner wall having an open top and open bottom;

each of said outer wall and said inner wall comprising a base portion and a mouth portion wherein said base portion has a horizontal cross-sectional area substantially greater than the horizontal cross-sectional area of said mouth portion;

said outer wall and said inner wall being secured to each other at the mouth portion of each wall;

an inner base wall member secured to the base portion of said inner wall;

an outer base wall member secured to the base portion of said outer wall; and said inner wall and said outer walls and said inner and outer base wall members defining an insulating space therebetween.

2. The beverage mug of claim 1, wherein each of said inner wall and said outer wall further comprises a tapered portion between said base portion and said mouth portion.

3. The beverage mug of claim 2, wherein said tapered portion is substantially frustoconical.

4. The beverage mug of claim 1, wherein said inner and outer walls are generally circular in horizontal cross-section.

5. The beverage mug of claim 2, wherein said inner and outer walls further comprise a neck portion below said mouth portion and above said tapered portion.

6. The beverage mug of claim 5, wherein said neck portion is generally non-tapered.

7. The beverage mug of claim 6, wherein said neck portion is generally cylindrical.

8. The beverage mug of claim 1, wherein said insulating space is filled with insulation.

9. The beverage mug of claim 8, wherein said insulation is a closed cell foam.

10. The beverage mug of claim 1, wherein said inner wall is substantially equidistant from said outer wall throughout a substantial portion of the area of said walls.

11. The beverage mug of claim 1, wherein said inner wall follows the contour of the outer wall.

12. The beverage mug of claim 1, wherein said mug has a generally vertical axis and said walls are generally coaxially disposed along said vertical axis and said outer base wall member and said inner base wall member are substantially perpendicular to said vertical axis.

13. The beverage mug of claim 4, wherein a ratio of the diameter of said base portion of said outer wall to the diameter of said mouth portion of said outer wall is from about 6/2.5 to about 5/4.5, and a ratio of the diameter of said base portion of said inner wall to said diameter of said mouth portion of said inner wall is from about 5/1.5 to about 4/3.5.

14. The beverage mug of claim 13, wherein said ratio for said outer wall is about 5/3.6 and said ratio for said inner wall is about 4/2.6.

15. The beverage mug of claim 10, wherein the distance between said inner wall and said outer wall varies less than about ⅛ inch over the area of the mug.

16. A beverage mug, for containing hot or cold beverages without substantial spillage, said mug being produced by a process comprising:

a) joining an inner base wall member formed of a polymeric material to a base portion of an endless inner wall formed of a polymeric material, said endless inner wall having an open top and open bottom, the base portion and a mouth portion, wherein said base portion has a horizontal cross-sectional area substantially greater than a horizontal cross-sectional area of said mouth portion;

b) joining said inner wall to an endless outer wall formed of a polymeric material, forming an insulating space between said inner and outer wall, said endless outer wall having an open bottom, an open top, a base portion and a mouth portion, wherein said base portion has a horizontal cross-sectional area substantially greater than a horizontal cross-sectional area of said moth portion, said joining being conducted at said mouth portion of each wall;

d) introducing an expandable insulating foam material between said outer and inner walls; and e) joining a polymeric outer base wall member to said bottom end of said outer wall.

* * * * *

UNITED STATES PATENT AND TRADEMARK OFFICE

CERTIFICATE OF CORRECTION

PATENT NO. : 5,515,995

DATED : May 14, 1996

INVENTOR(S) : M. ALLEN et al.

It is certified that error appears in the above-indentified patent and that said Letters Patent is hereby corrected as shown below:

At column 11, line 5 (claim 16, line 18), change "moth" to ---mouth---.

Signed and Sealed this

Fifth Day of November, 1996

Bruce Lehman

*Attest:*

BRUCE LEHMAN

*Attesting Officer*

*Commissioner of Patents and Trademarks*